United States Patent [19]

Duke

[11] Patent Number: 4,884,800

[45] Date of Patent: Dec. 5, 1989

[54] ROWING MACHINE

[76] Inventor: John H. Duke, 19 Cold Spring St., Providence, R.I. 92906

[21] Appl. No.: 348,782

[22] Filed: May 8, 1989

Related U.S. Application Data

[63] Continuation of Ser. No. 49,616, May 13, 1987, Pat. No. 4,846,460.

[30] Foreign Application Priority Data

Nov. 17, 1988 [WO] PCT Int'l Appl. ..... WO88/08735

[51] Int. Cl.[4] ..... A63B 69/06

[52] U.S. Cl. ..... 272/72; 272/130

[58] Field of Search ..... 272/72, 130, 71, 116, 272/134

[56] References Cited

U.S. PATENT DOCUMENTS

| | | | |
|---|---|---|---|
| 2,042,764 | 6/1936 | Birch | 272/130 |
| 2,131,570 | 9/1938 | Riley | 272/72 |
| 2,725,231 | 11/1955 | Hoover | 272/72 |
| 3,373,992 | 3/1968 | Ludeman | 272/130 X |
| 4,396,188 | 8/1983 | Dreissigacker et al. | 272/72 |
| 4,537,396 | 8/1985 | Hooper | 272/130 |
| 4,688,791 | 8/1987 | Long | 272/130 X |
| 4,743,011 | 5/1988 | Coffey | 272/130 X |

*Primary Examiner*—Richard J. Apley
*Assistant Examiner*—Franklin L. Gubernick
*Attorney, Agent, or Firm*—Wolf, Greenfield & Sacks

[57] ABSTRACT

A compact portable rowing machine features a hollow container that holds a supply of water. Pulling on a drive cord during a pulling segment of a stroke rotates a paddle or like mechanism located within the container to rotate the water to produce a momentum effect. Turbulence in the water provides fluid resistance to the rotation of the paddle. A drive cord is wrapped on a double spool mounted on a clutch to drive the paddle in one direction. The wrapping is such that changing the length of the drive cord between the spool and a handle gripped by a user changes the radius at which tangential force is applied by the cord to the spool to vary the resistance of the machine. In one form the drive cord also forms a portion of the recoil mechanism as a continuous closed loop strap secured at its ends to different spools of a double spool. A continuous portion of the drive cord located between the handle and one spool is to secured to the handle. The handle is constructed so that in a normal operating orientation its position on the strap is fixed, but in an unlocked orientation it may be be moved any degree to increase or decrease the resistance of the machine.

3 Claims, 8 Drawing Sheets

FIG. 8A
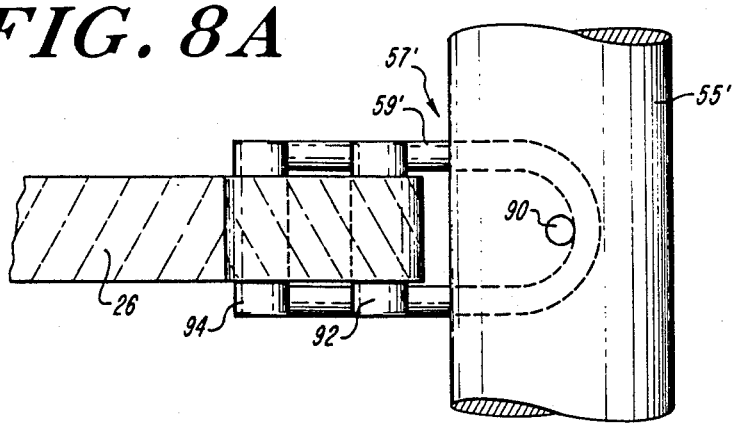
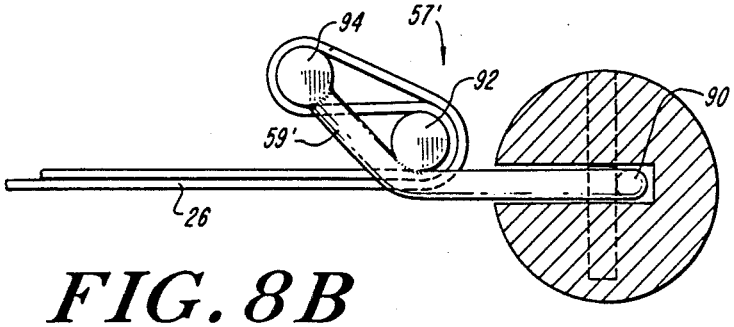
FIG. 8B
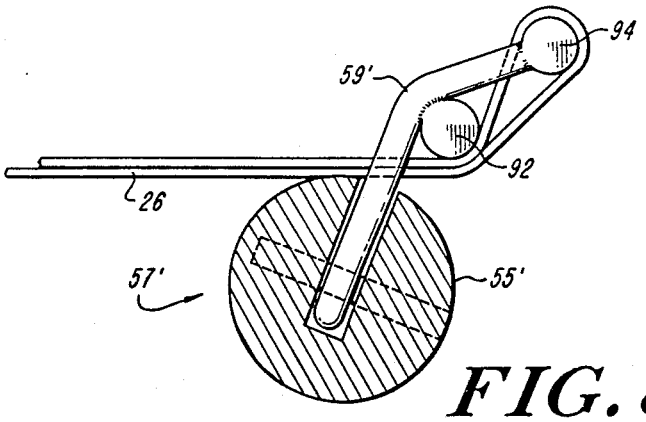
FIG. 8C

ROWING MACHINE

This application is a continuation, of U.S. patent application Ser. No. 049,616, filed May 13, 1987, now U.S. Pat. No. 4,846,460.

BACKGROUND OF THE INVENTION

This invention relates in general to exercise equipment. More specifically, it relates to a portable rowing machine which provides a momentum effect to simulate closely the sensation of actually rowing and also simulates the sound of actually rowing.

Presently available rowing exercise machines either have an ability to store energy between the strokes, or they do not. This ability, commonly termed the momentum effect, is valuable for a variety of reasons. Exercise devices in the form of rowing units employing a flywheel to produce the momentum effect are superior to other units because they closely simulate the feel of rowing a real boat. The momentum effect gives the sensation of accelerating an inertial mass (the flywheel) during the pulling segment of the stroke, a sensation which is similar to that of accelerating a real boat. On the recovery segment the flywheel decelerates to a certain extent but maintains a large portion of its stored energy just as a boat maintains its forward momentum. The momentum effect also serves to establish a steady rhythm which makes the use of the device more enjoyable and is a superior mode of exercise in promoting cardiovascular fitness. Here the flywheel stores energy which has been imparted over a series of strokes, so a deviation in cadence or pulling force will result in a change in energy level. Regaining that level will require a compensating change in power delivered over succeeding strokes, immediately apparent as a change in the resistance offered by the unit. In this way the flywheel functions as a feedback mechanism acting to maintain a consistent rhythm and level of effort, which are desirable in cardiovascular type exercises.

In prior devices using flywheels, rotation is typically impeded by fluid or frictional resistance. Examples of devices employing fluid resistance generally employ ambient air or closed hydraulic media. These include U.S. Pat. Nos. 4,396,188; 4,249,725; and 3,266,801. Examples of devices employing frictional resistance include U.S. Pat. Nos. 4,047,715 and 247,532. These units generally employ friction elements which are held in contact with some surface of the flywheel by the action of weights, springs, setscrews or the like. In fluid resistance units the resistance is generally proportional to the speed of rotation of the flywheel. This is not true of frictional devices.

While these prior art rowing machines produce a momentum effect, they do not also produce sounds which simulate actual rowing. Further, the flywheels used in these devices are typically heavy, cumbersome or both. These qualities reflect adversely in shipping the machines, and in their cost of manufacture. The only known rowing machines which utilize actual water are large, fixed installations where one to eight rowers pull on conventional oars which reach to an open-top body of water. In large facilities of this type, there are two open-top water tanks on either side of the rowers with conduits and pumps to assist in circulating the water through the tanks. These installations are extremely expensive and not portable.

Another desired operating characteristic of rowing machines and the like is to be able to vary resistance of the machine, both before and during exercise to accomodate users having varying physical characteristics and to vary the response of the machine during an exercise. While various adjusting mechanisms are known, most require the user to stop the exercise routine for a period of time which substantially interrupts the rhythm of the exercise.

It is therefore a principal object of this invention to provide a portable rowing machine that provides a momentum effect that closely simulates actual in-water rowing and also simulates the sound of actual rowing.

Another principal object is to provide a rowing machine with the foregoing advantages that is compact and has a comparatively low weight.

Another object is to provide a rowing machine which readily allows an adjustment in the resistance of the machine without substantially interrupting the exercise.

A further object is to provide these advantages while at the same time being mechanically simple and requiring no special water seals around rotating members.

SUMMARY OF THE INVENTION

The rowing machine of the present invention is of the reciprocating type with alternating pulling and recovery segments. The machine is organized about a frame that mounts a small hollow container that holds a supply of water. A paddle or the like is rotatably mounted in the container and coupled, preferably through a double spool and a clutch, to a drive cord and a recoil mechanism. The paddle is oriented to rotate the water about the major axis of the container in response to a pulling movement on the drive cord. The mass of the spinning water produces the momentum effect and turbulence generated in the water provides the desired resistance. In the preferred form the container has a generally cylindrical configuration. Also, the water supply preferably fills less than half the container so that the water will not leak past any rotary couplings or bushings for the paddles when the rowing machine is oriented vertically for storage. The spool is preferably one which wraps the drive cord with a diameter that varies with the degree of wrapping so that an adjustment in the length of the drive cord produces a corresponding change in the rate of rotation of the paddle and hence the resistance of the machine.

To adjust the resistance of the machine on the pulling segment, the invention provides a handle having a central portion that is coupled to the drive cord and a pair of hand grips secured to the central portion. In the preferred form the drive cord is continuous in the region of the handle and secured at one end to the top groove and at its opposite end to the bottom groove of the double spool. The central region of the handle produces a turn in the cord and the handle is configured so that the force of the pulling segment locks the position of the handle on the cord. Rotation of the handle allows it to be moved along the strap to vary the resistance of the machine without substantially interrupting the exercise. In another form, one end of the drive cord is fixed to the central member and wrapped around it, and the hand grips are offset from the central member to develop a moment that resists an unwrapping of the cord on the pulling segment. The moments acting on the handle hold a given degree of wrapping, but a rotation of the handle places it in an orientation to facilitate the winding or unwinding of the cord without interrupting the cadence. In this form a separate recoil cord acts to rewind the double spool.

These and other features and objects of the present invention will be more fully understood from the following detailed description which should be read in light of the accompanying drawings.

Figure 6:
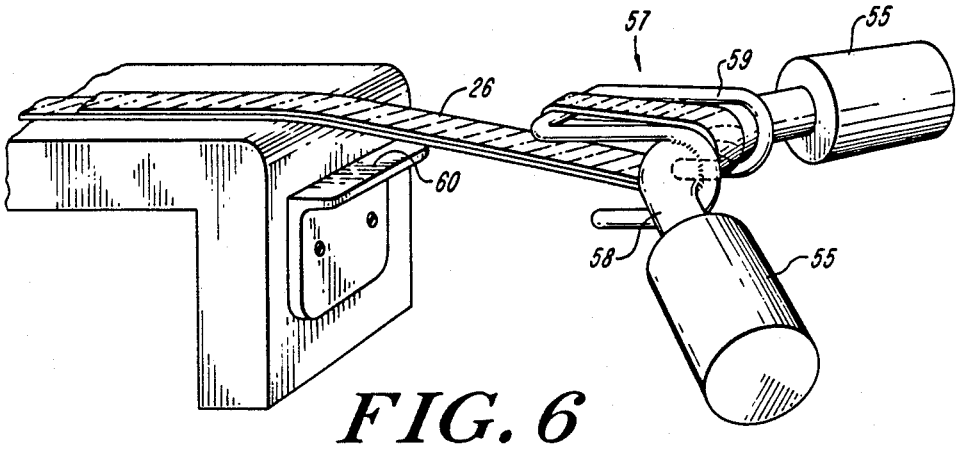
FIG. 6 is a detailed perspective view of the handle shown in FIGS. 1–5 and also showing a mechanism for securing the handle to the frame when the machine is not in use.
Figure 7A:
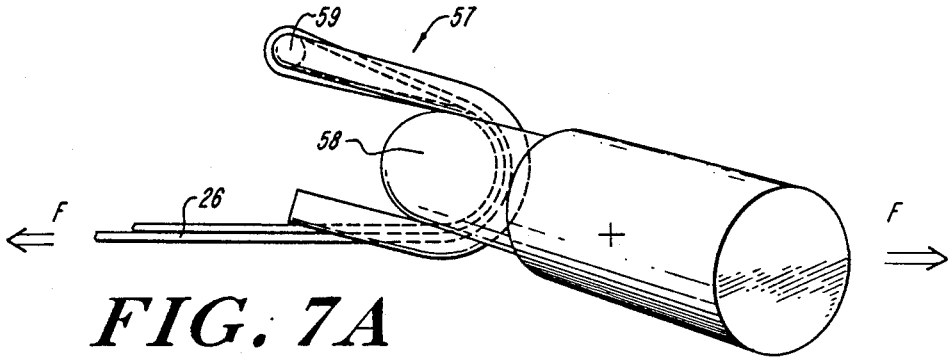
Figure 7B:
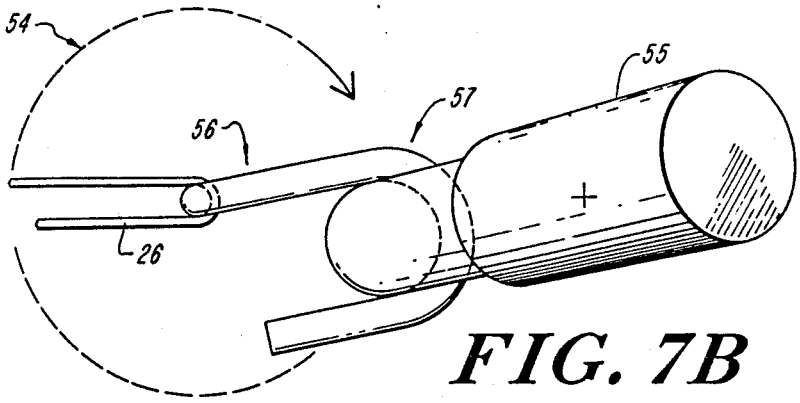

FIG. *7a* shows a locked orientation of the handle shown in FIG. 6;

FIG. *7b* shows an unlocked orientation of the handle shown in FIG. *7a;*

FIGS. *8a* and *8b* show in top plan view and a view in vertical section respectively, a locked orientation of the central portion of an alternative handle;

FIG. *8c* shows in vertical section an unlocked orientation of the handle shown in FIGS. *8a* and *8b;*

Figure 9:
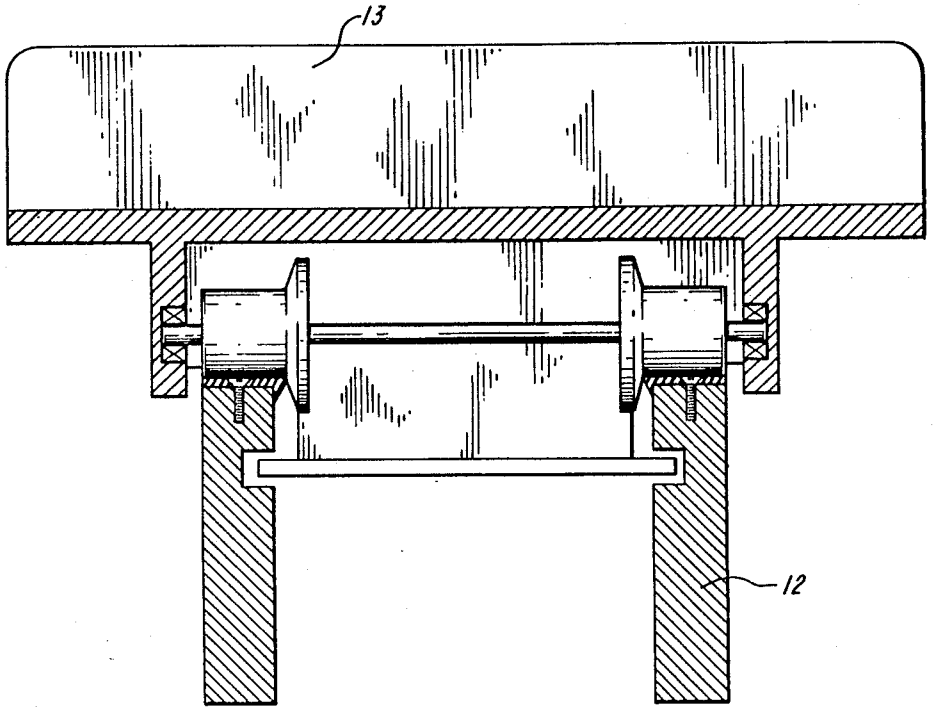
Figure 10:
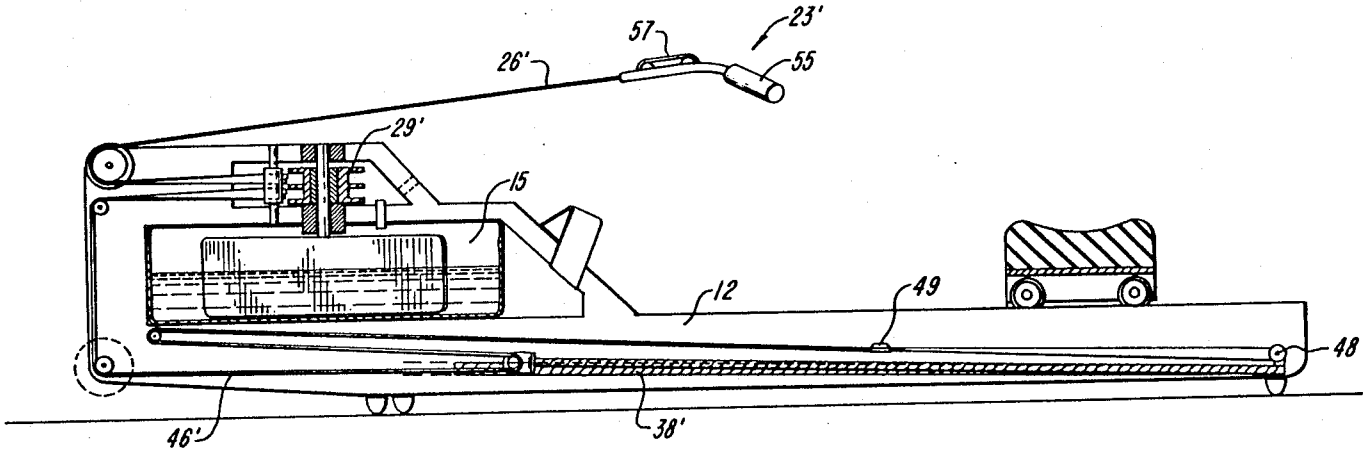

FIG. 9 is a view in vertical section of the seat mounting arrangements of the rowing machine shown in the previous drawings;

FIG. 10 is a view in vertical section of a rowing machine having an alternative arrangement to adjust resistance.

DETAILED DESCRIPTION OF THE PREFERRED EMBODIMENTS

Figure 1:
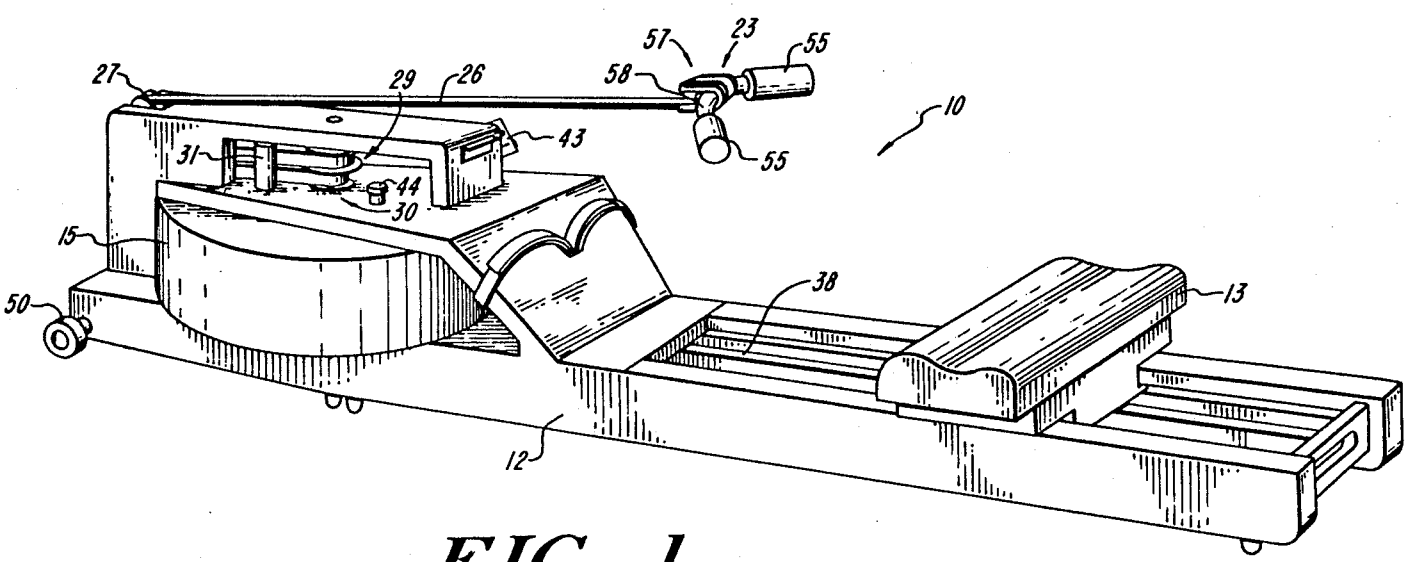
FIG. 1 is a view in perspective of a rowing machine according to the present invention.
Figure 2:
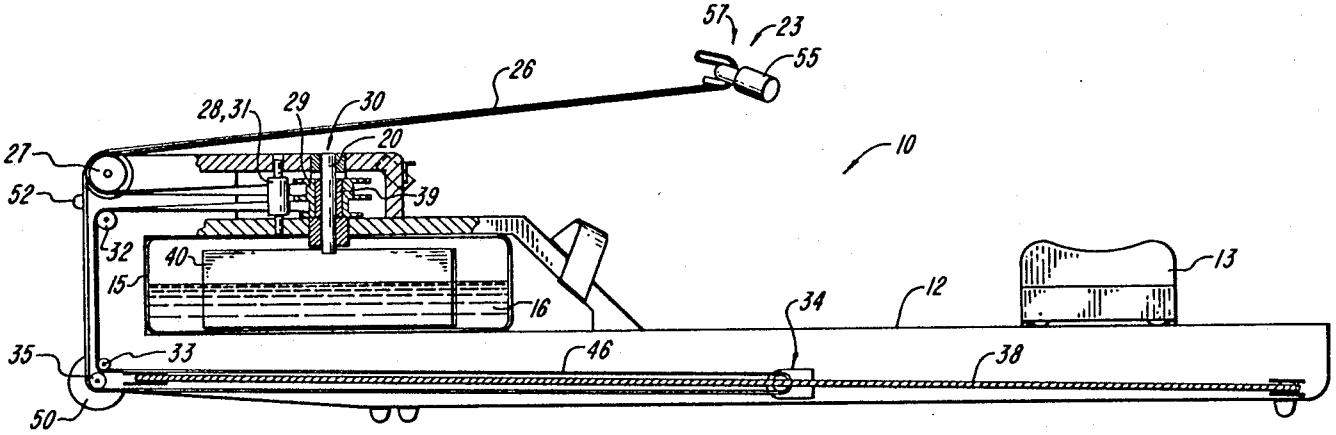
FIG. 2 is a view in vertical section of the rowing machine shown in FIG. 1.
Figure 3:
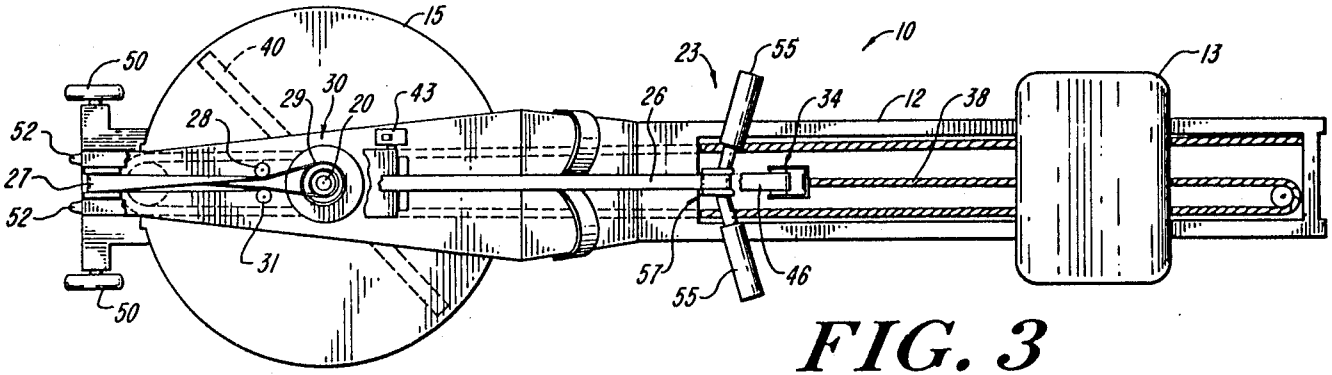
FIG. 3 is a top plan view of the rowing machine shown in FIG. 1.

FIGS. 1–3 show a rowing machine 10 that has a frame number 12 capturing a hollow tank 15, containing a drive mechanism 30, and carrying a sliding seat 13 where the user sits when exercising. The tank is preferably a molded plastic which offers a very favorable shipping weight and cost of manufacture when compared to conventional flywheels. A tank diameter of about twenty-two inches has been found to give good results while still being compact, low in weight and portable. A supply of liquid, preferably water, is added to the tank via the opening filled by plug 44 before use. As will be described below, the spinning water supply acts like a flywheel to provide a momentum effect.

In one form illustrated in FIGS. 1–4, a handle 23 attaches to a drive cord 26 which passes horizontally over pulley 27, twists 90 degrees and passes vertically around pulley 28, and finally winds about and fastens to the upper groove of a double spool 29. The drive cord is preferably in the form of a strap and made of webbing. A rewind strap 46, in this form consisting of the opposite end of drive strap 26, winds about the lower groove of the double spool in the direction opposite the drive strap. From the double spool the rewind strap passes vertically around pulley 31, twists 90 degrees and passes horizontally over pulleys 32, 33 and 34, and then returns to the handle via pulleys 35 and 27. Anelastic cord 38 is coupled at one end to pulley 34 and secured at its opposite end to the frame. It draws the pulley 34, and the cord 46 looped around the pulley 34, in a direction which acts to maintain tension in cord 26 during the recovery segment of the stroke.

Figure 4:
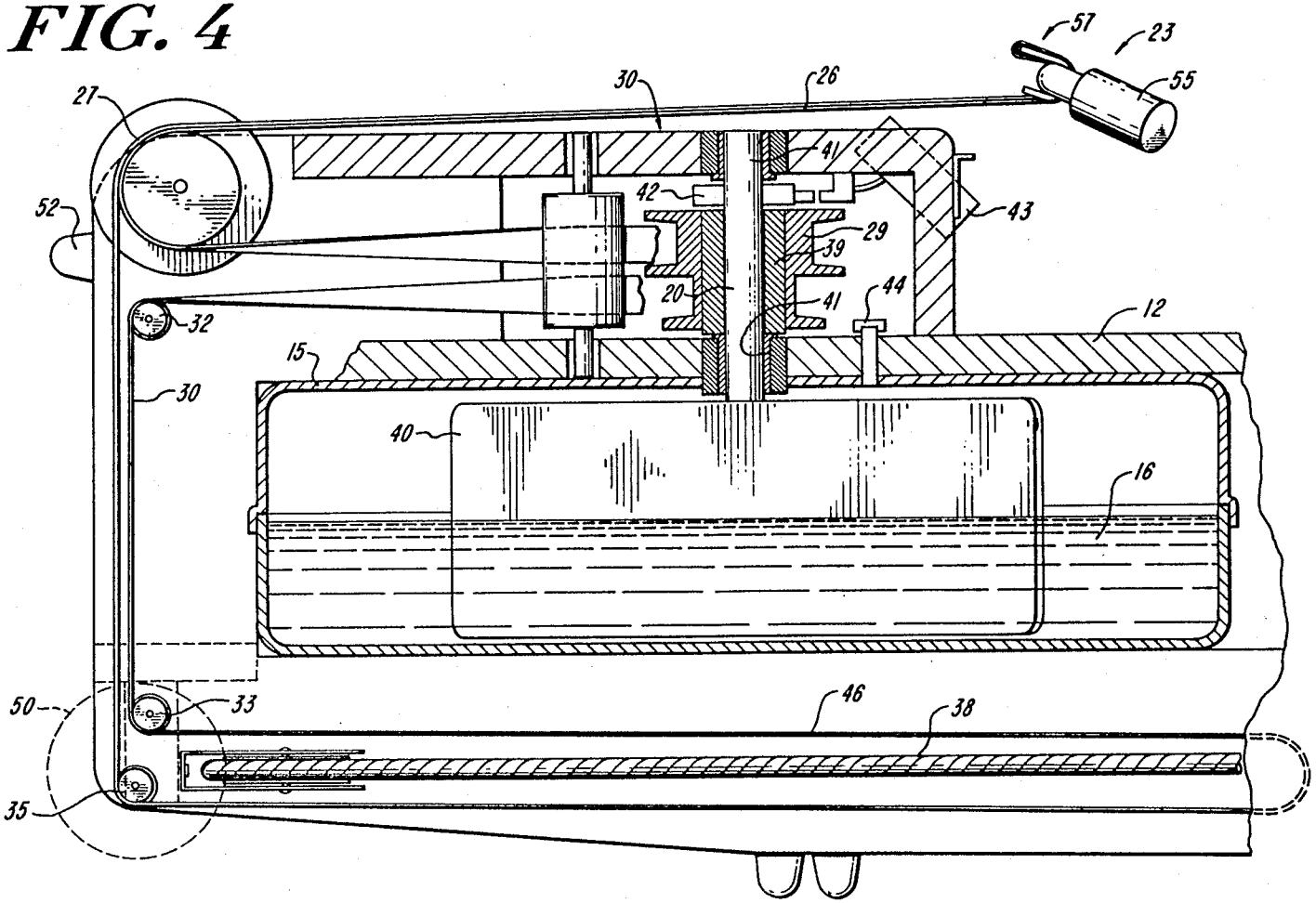
FIG. 4 is a detail view in vertical section of the drive mechanism and water drum shown in FIGS. 1–3.

The double spool 29 is mounted upon a roller clutch assembly 39 through which a shaft 20 is journaled. The shaft connects directly to a paddle 40 which imparts circular motion to a fluid 16, typically water, in the tank 15. The top frame member 12 supports the shaft in suitable bearings 41. A clamping collar 42 secures the shaft against axial movement and provides a takeoff for an instrument 43 which displays rate of paddle rotation and other desired information in appropriate units. The plug 44 allows filling and draining of the tank 15. As shown in FIGS. 2–4, the paddle preferably extends laterally so that it is closely spaced from the side wall of the tank 15, a spacing of ¼ inch being typical. With this arrangement, rotation of the paddle 40 and the water 16 produce a water sound similar to that produced by a rowing shell.

Operation of the device consists of a drive segment of the stroke during which the operator pulls on the handle 23 and a recovery segment during which the recoil mechanism (the shock cord 38 acting on the strap 46 through the pulley 34) returns the handle to an original position for the next drive. During the drive segment unwinding of the drive strap 26 from the double spool 26 rotates the spool in the direction in which the roller clutch assembly 39 engages the shaft 20. Rotation in this direction causes rewind strap 46 to wind on the double spool, and by translation of the pulley 34, stretch the elastic cord 38. On the recovery segment the elastic cord contracts and the rewind strap rotates the spool in the opposite direction thereby rewinding the drive strap. While the spool rotates in this direction the clutch disengages allowing the shaft to continue turning in the first direction.

Figure 5:
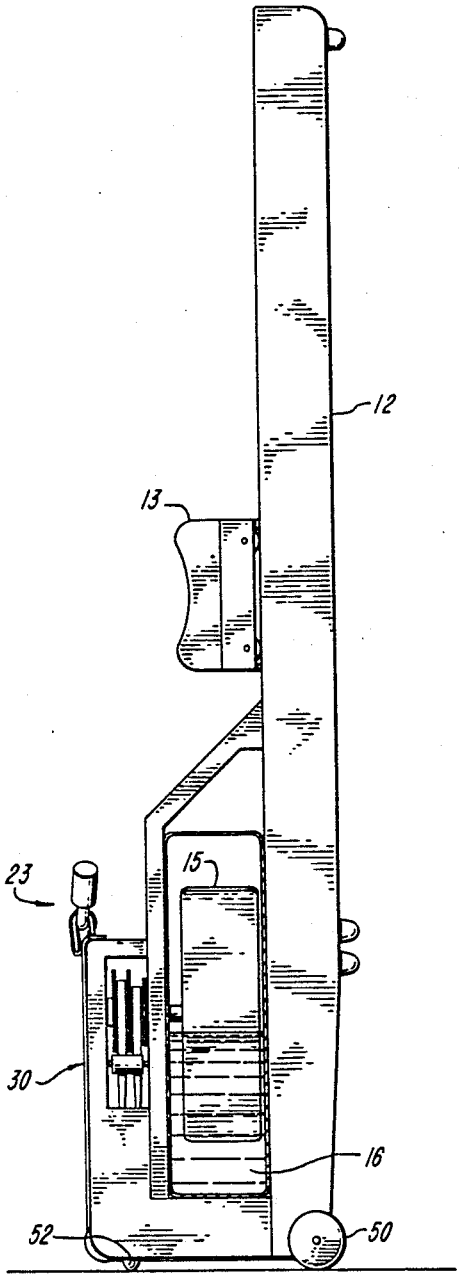
FIG. 5 is a view in side elevation of the rowing machine of FIGS. 1–4 stored vertically on one end.

FIG. 5 shows the rowing machine of the present invention in a vertical orientation for storage. The machine can be easily transported by simply lifting the end opposite the the tank 15, rolling the unit on wheels 50, and then placing it in a full upright position on the wheels 50 and supports 52. Note that the volume of the water supply 16 is preferably less than half the interior volume of the tank 15. As a result, when the machine is stored, the water does not reach the bearings 41 for the rotating shaft 20 and special water seals are not required.

With particular reference to FIG. 4, the drive and recoil mechanisms which also allow a convenient adjustment of the resistance of the rowing machine secure the ends of the drive strap 26 to the upper and lower grooves of the spool 29. The body of the strap forms a loop which passes, via various pulleys and rollers as shown, through both the handle 23 and a pulley 34 linked to the end of the elastic cord 38. The handle 23 is shown here and in FIG. *7a* in its locked orientation whereby when one pulls on the grips the strap is prevented from slipping with respect to the handle. By changing the location on the strap where the handle is locked, one can alter the proportion between the respective number of winding turns which the strap takes on the upper and lower grooves of the spool. This has the effect of changing the rotational speed of the paddle over a given stoke and the level of resistance as described above. For example, locking the handle at a point closer to the end of the strap fixed to the upper groove of the spool makes the strap unwind from the upper groove and therefore operate at a smaller average diameter and rotate faster over the extent of a given stroke. As the end of the strap unwinds from the upper groove, the opposite end winds up on the lower groove, thus maintaining tension in the loop. Varying the unit's resistance in this way stretches or contracts the elastic cord only to the extent that the aggregate length of strap wound on both grooves changes. The opposite occurs when the handle is moved in the opposite direction as shown by arrow 48 in FIG. *7b*.

The handle shown in FIGS. *7a* and *7b* consists of hand grips 55, a bent metal tube 58 and a bent metal rod element 59 welded to the tube. In its rest position, the rod ends engage an angle plate 60 mounted on the top frame member 12. One unlocks the handle by rotating it through almost a full motion, as depicted by arrow 54 to an "unlocked" position shown in FIG. *7b*. In the unlocked position, the strap may be moved freely through an opening 56 formed by the bent rod without substantially interrupting the exercise.

In another form, the level of resistance offered by the rowing machine 10 may be varied by winding or unwinding the drive strap 26' around the handle 23' (see FIG. 10). Winding on the handle causes the drive strap to unwind at its opposite end from the double spool 29', thereby reducing the spool's effective diameter. For the distance of handle travel on a given stroke a spool of smaller effective diameter unwinds at a higher rotational speed and spins the fluid in the tank 15' faster, which yields a proportional increase in resistance. Unwinding the drive strap from the handle reduces the speed of rotation in an opposite fashion. A pair of hand grips 55 on the handle are bent slightly downwardly and away from a central member 57 to produce a moment of force on the pulling segment that resists an unwinding of the strap from the handle. In this form a separate strap 46' acts to rewind the double spool 29'. The end of strap 46' is adjustably secured to frame 12 by means of pulley 48 and sliding buckle 49. For large adjustments in resistance as described above, sliding buckle 49 adjusts the length of strap 46' so that elastic cord 38' operates over a desired range of motion.

The "single strap" arrangement and the handle construction shown in FIGS. *7a* and *7b* are preferred since there is some additional convenience and reliability in operation, because it does not require adjustment of the compensating buckle 49.

FIGS. *8a*, *8b* and *8c* show an alternative handle arrangement which operates in the same general manner as the handle shown in FIGS. *7a* and *7b*. The user grips a rod or bar 55' which is straight, not angled forwardly as in the other illustrated embodiments. A bent metal rod element 59' is secured in the bar 55' by a pin 90. The strap 26 in a doubled configuration wraps on a rod 92 welded across the element 59' and loops around a second rod element 94 also welded across the element 59'. These rod elements and a portion of the bar 55' form a central member 57'. In the normal operating position shown in FIGS. *8a* and *8b*, the tension in the strap creates a frictional force, particularly at the rod 92, which secures the handle at a selected position on the strap. In the release position shown in FIG. *8c*, the strap can slide over the rod 94 to adjust the position of the handle and hence the resistance of the rowing machine 10, as described above.

There has been described a rowing machine that is portable, compact and suitable for home use which also closely simulates the feel and sound of actual rowing in a way that had heretofore only been attainable in massive commercial installations used for training competitive rowing crews. The rowing machine has a comparatively low weight for shipping since the water for the flywheel effect can be simply omitted or drained from the container. The machine also allows a user to change the resistance of the machine without substantially interrupting the exercise. Moreover, all of these advantages are provided with a comparatively simple, cost-effective design that does not require expensive water seals.

While the invention has been described with respect to its preferred embodiments, it will be understood that various modifications and alterations will occur to those skilled in the art. For example, while the invention has been described with respect to a rectangular paddle rotating in a cylindrical tank approximately half filled with water, various shapes of tanks, arrangements for propelling the water and generating turbulence and various other liquid levels are possible. These and other modifications and variations are intended to fall within the scope of the appended claims:

What is claimed is:

1. In an exercise device having frame means, a drive cord capable of reciprocal motion during cycles of operation including a pulling segment in which the drive cord is unwound from a recoil mechanism in a first direction and a recovery segment in which the drive cord moves in the direction opposite said first direction and is rewound on said recoil mechanism said recoil mechanism being mounted on the frame means, the improvement comprising:

a hollow container mounted on said frame;

a supply of liquid held in said container, liquid rotating means rotatably mounted within said container at its center and spaced from the walls of said container to rotate said supply of liquid within said container in response to movement of said drive cord during said pulling segment, said container having an inner surface in contact with said liquid, said inner surface being shaped to allow free movement of the liquid thereby allowing said supply of liquid to continue to rotate within said container during said recovery segment to produce thereby a liquid flywheel moving within said container and thereby maintaining the rotation of the liquid rotating means during the recovery segment and translating means mounted on said frame means and operatively connected to said liquid rotating means for translating a reciprocating motion of said drive cord during each cycle of operation into a one-way rotation of said liquid rotating means in response to said pulling segment of said cycle of operation, said translating means being coupled to said drive cord and said recoil mechanism, said supply of liquid when rotating producing resistance to said pulling segments due principally to turbulence at the liquid-container interface, and said liquid rotating means being capable of rotating in unison with said rotating liquid during said pulling and recovery strokes.

2. The improved exercise device of claim 1 wherein said container is closed.

3. The improved exercise device of claim 1 wherein said supply of liquid fills less than half of the interior volume of said container.

* * * * *